US007466288B2

(12) United States Patent
Huang

(10) Patent No.: US 7,466,288 B2
(45) Date of Patent: Dec. 16, 2008

(54) COMBINATION OF ANTENNA TERMINAL AND RECEPTION MEMBER

(76) Inventor: Chung-Chuan Huang, No. 31, Lane 57, Jhengnan 1st St., Yongkang City, Tainan County 710 (TW)

( * ) Notice: Subject to any disclaimer, the term of this patent is extended or adjusted under 35 U.S.C. 154(b) by 105 days.

(21) Appl. No.: 11/724,160

(22) Filed: Mar. 15, 2007

(65) Prior Publication Data

US 2008/0224944 A1 Sep. 18, 2008

(51) Int. Cl.
*H01Q 1/50* (2006.01)
*H01Q 1/24* (2006.01)

(52) U.S. Cl. ..... 343/906; 343/702

(58) Field of Classification Search ..... 343/702, 343/906; 439/314, 332, 352, 357, 578, 680
See application file for complete search history.

(56) References Cited

U.S. PATENT DOCUMENTS 4,125,308 A * 11/1978 Schilling ..... 439/63
6,062,912 A * 5/2000 Witczak et al. ..... 439/680
6,808,407 B1 * 10/2004 Cannon ..... 439/314
7,329,139 B2 * 2/2008 Benham ..... 439/352
2006/0284771 A1 * 12/2006 Liang et al. ..... 343/702
2007/0024522 A1 * 2/2007 Lee ..... 343/906

* cited by examiner

*Primary Examiner*—Hoang V Nguyen
(74) *Attorney, Agent, or Firm*—Rosenberg, Klein & Lee

(57) ABSTRACT

An antenna assembly includes a reception member and an antenna terminal and the antenna terminal includes a metal core member which is inserted into the reception member. The reception member has an annular flange extending from an inner periphery thereof and a plurality of claws extend from a surface of the annular flange. An annular gap is defined between the claws and the inner periphery of the reception member. A plurality of ribs extend from the inner periphery of the reception member and located in the annular gap. The metal core member has an outer flange extending from an outer periphery thereof and the claws claw the outer periphery of the metal core member. The outer flange is in contact with the ribs.

5 Claims, 9 Drawing Sheets

COMBINATION OF ANTENNA TERMINAL AND RECEPTION MEMBER

FIELD OF THE INVENTION

The present invention relates to an antenna assembly including a reception member with integral claws for positioning the terminal of the antenna.

BACKGROUND OF THE INVENTION

A conventional connection of an antenna terminal and a reception member is shown in FIG. 1 and generally includes a receiving box 10 with two reception members 101 extending from a rear side thereof and each reception member 101 includes outer threads 102. A terminal 30 of an antenna is connected to the reception member 101 by threadedly mounted to the outer threads 102 of the reception member 101. As shown in FIGS. 2 and 3, the terminal 30 includes a metal core member 301 with an insertion end 3011, a plastic washer 302, a spring 303, two conductive rings 304, 305, a locking member 306 and an isolation member 307. The insertion end 3011 extends through the plastic washer 302, the spring 303, the conductive rings 304, 305 and fixedly connected in the locking member 306, The metal core member 301 is in contact with the plastic washer 302. The isolation member 307 is inserted into the insertion end 3011 of the metal core member 301. The locking member 306 is then rolled to form an inward groove to be fixedly connected to the antenna 20. However, the spring 303 is located between the plastic washer 302 and the conductive ring 304 so that when antenna 20 is rotated to be positioned a better orientation to receive stronger signal, the spring 303 is co-rotated and generates noise. Besides, the spring 303 is compressed by the plastic washer 302 and the conductive ring 304 and the torque is applied to the spring 303 during the adjusting of the antenna 20, the spring 303 reaches its limit of fatigue quickly and the antenna 20 cannot be well positioned after being rotated. Furthermore, it requires a process of rolling which increases assembly time and cost.

The present invention intends to provide a combination of an antenna terminal and a reception member wherein the terminal is clawed by claws in the reception member and no spring is used so that the shortcomings of the conventional connection are improved.

SUMMARY OF THE INVENTION

The present invention relates to an antenna assembly that comprises a reception member having an annular flange extending from an inner periphery thereof and a plurality of claws extend from a surface of the annular flange. An annular gap is defined between the claws and the inner periphery of the reception member. A plurality of ribs extend from the inner periphery of the reception member and located in the annular gap. An antenna terminal includes a metal core member that has an insertion end which is inserted into the reception member. An outer flange extends from an outer periphery of the metal core member. The claws claw the outer periphery of the metal core member and the outer flange contacts the ribs.

The primary object of the present invention is to provide an antenna assembly wherein no noise is generated when rotating the antenna.

Another object of the present invention is to provide an antenna assembly wherein no spring and rolling process are needed.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
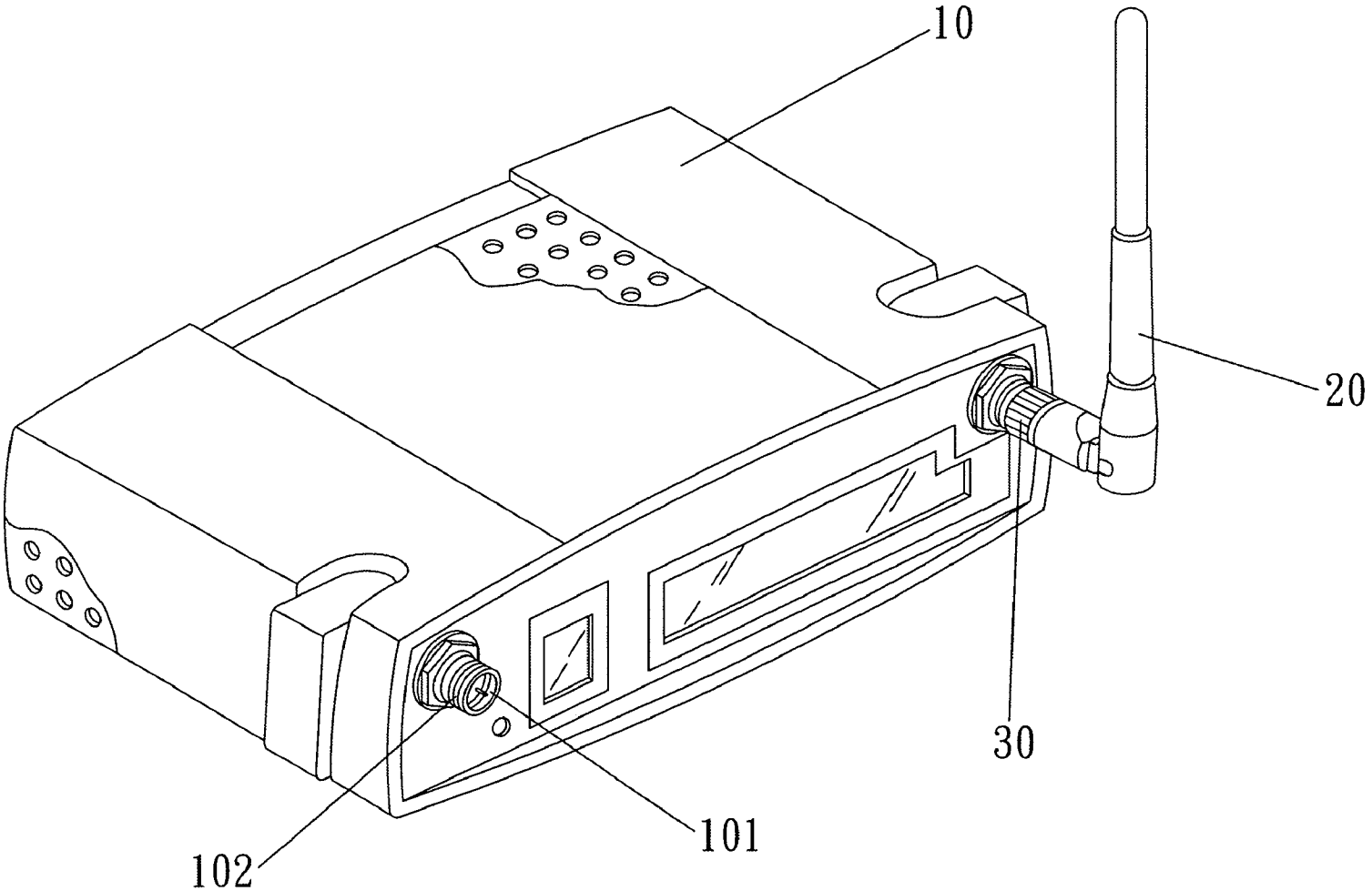
FIG. 1 PRIOR ART
FIG. 1 shows a conventional antenna connected with a conventional reception member.
Figure 2:
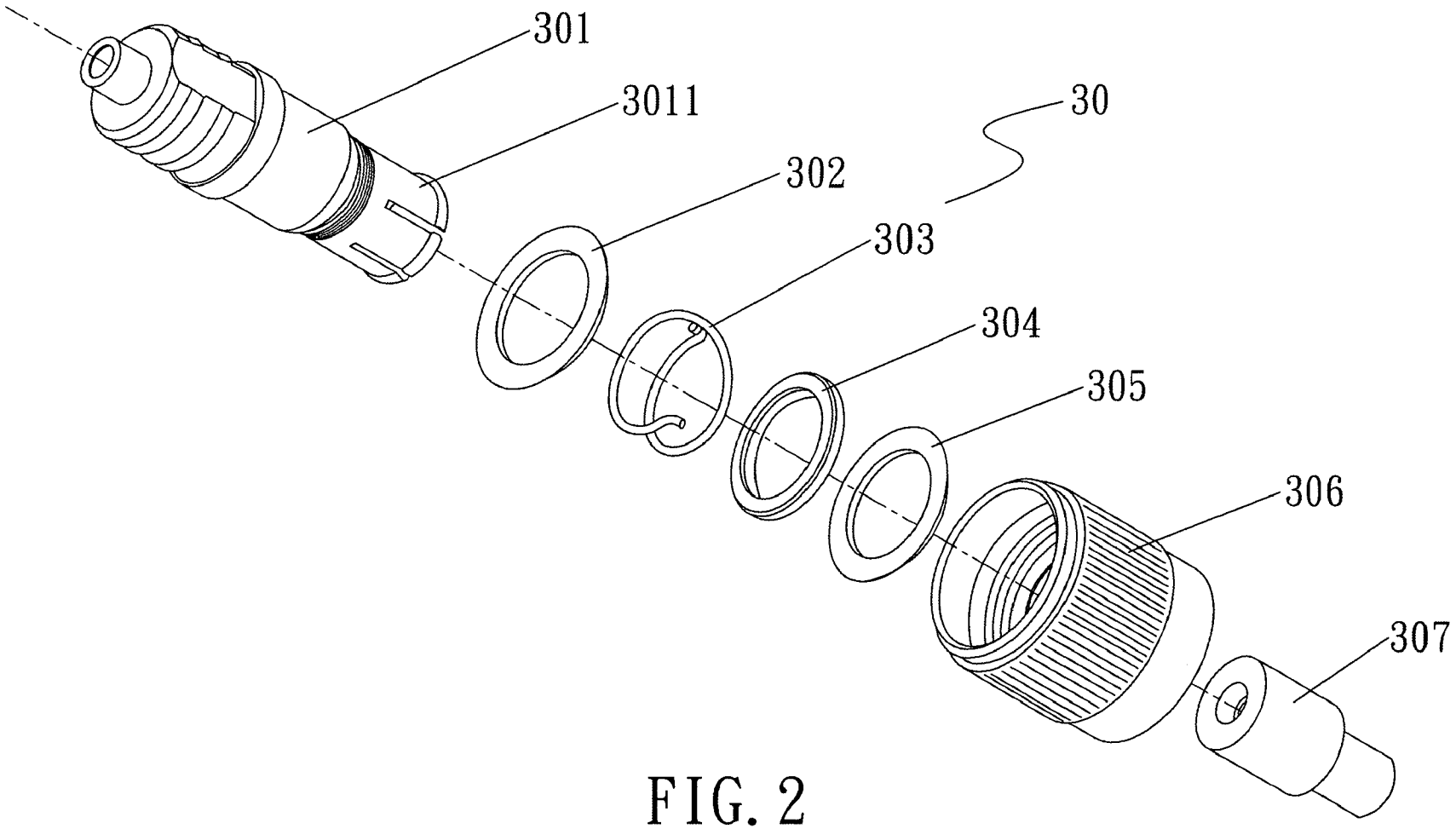
FIG. 2 PRIOR ART
FIG. 2 is an exploded view to show the conventional antenna terminal and the conventional reception member.
Figure 3:
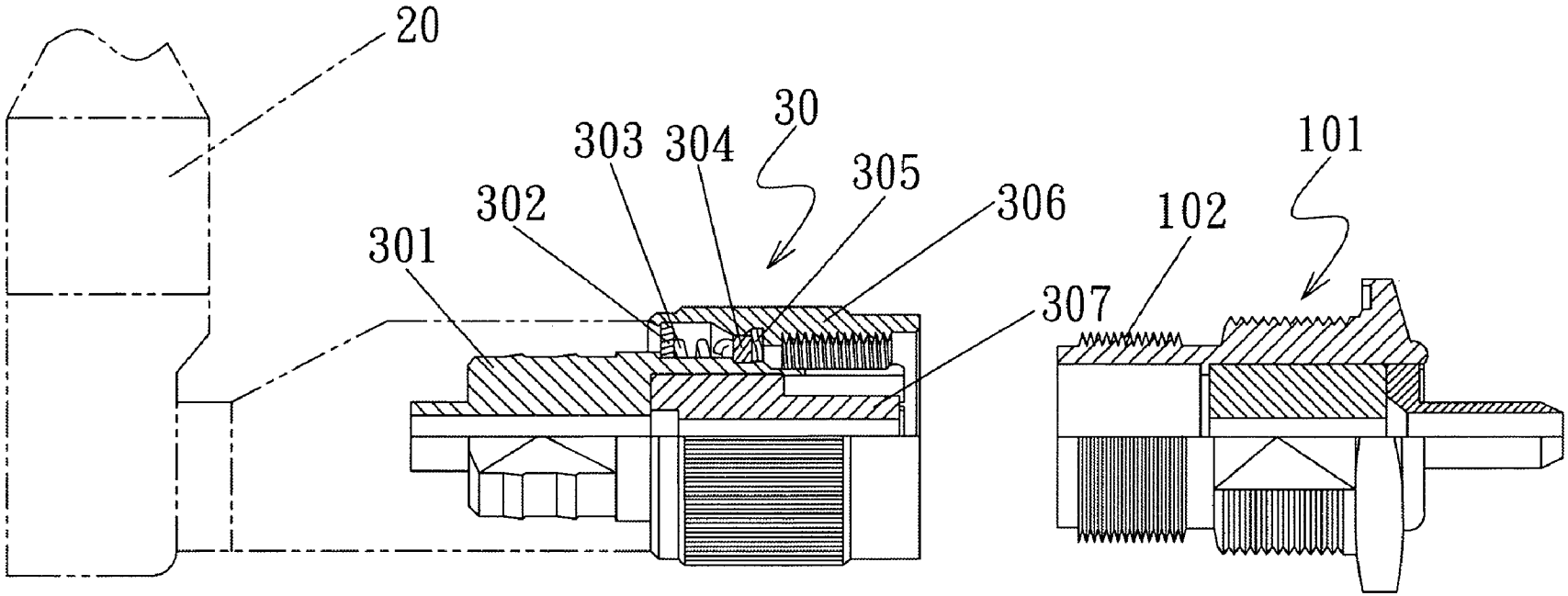
FIG. 3 PRIOR ART
FIG. 3 is a cross sectional view to show the conventional antenna terminal and the conventional reception member.
Figure 4:
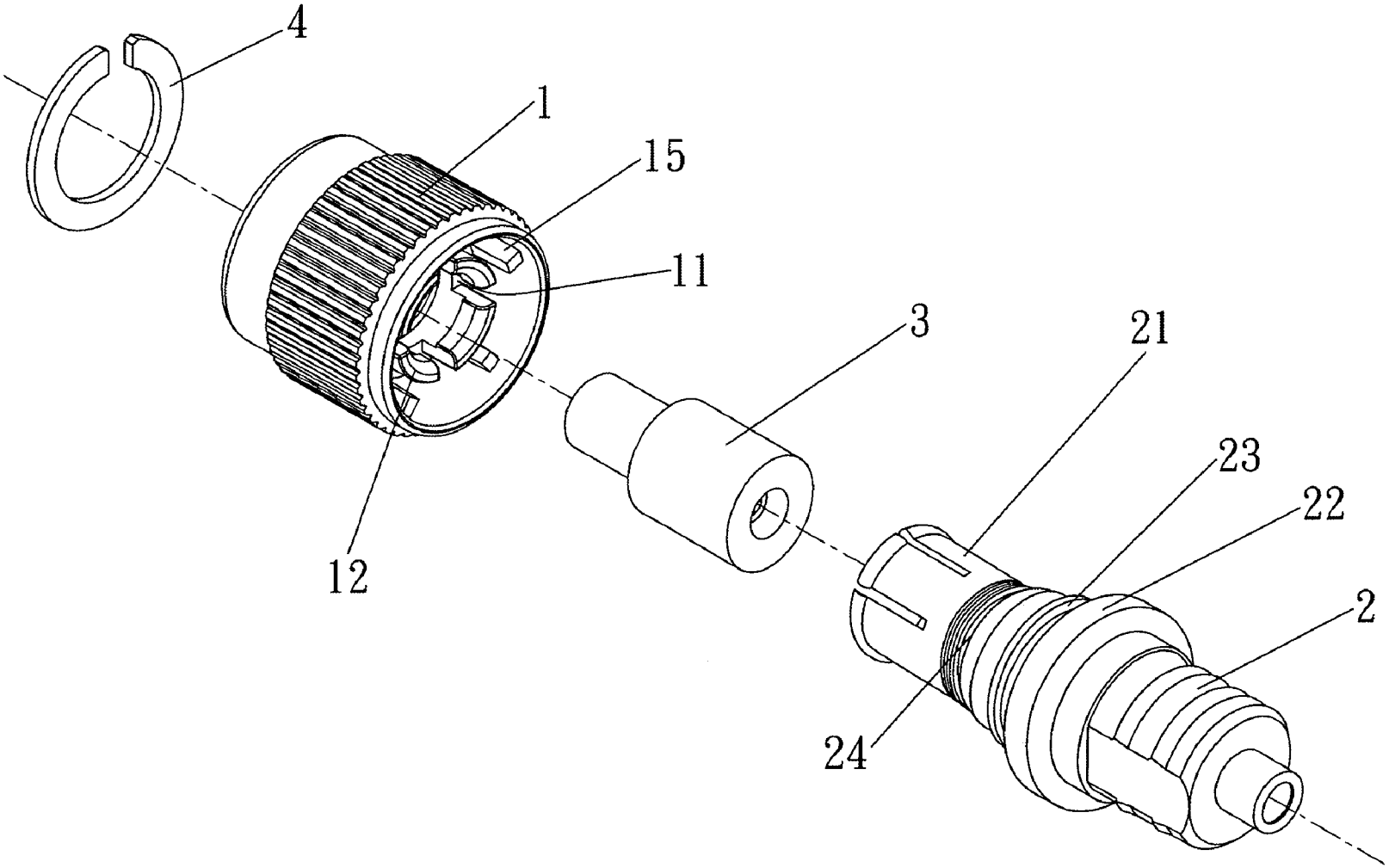
FIG. 4 is an exploded view to show the antenna terminal and the reception member of the present invention.
Figure 6:
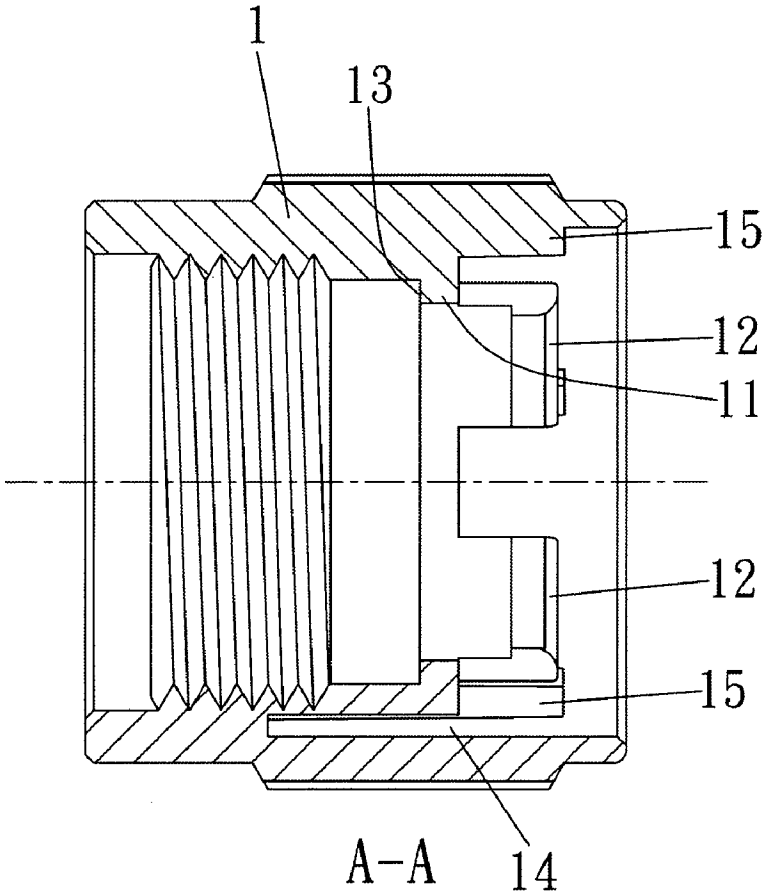
FIG. 6 is a cross sectional view along line A-A in FIG. 5.
Figure 5:
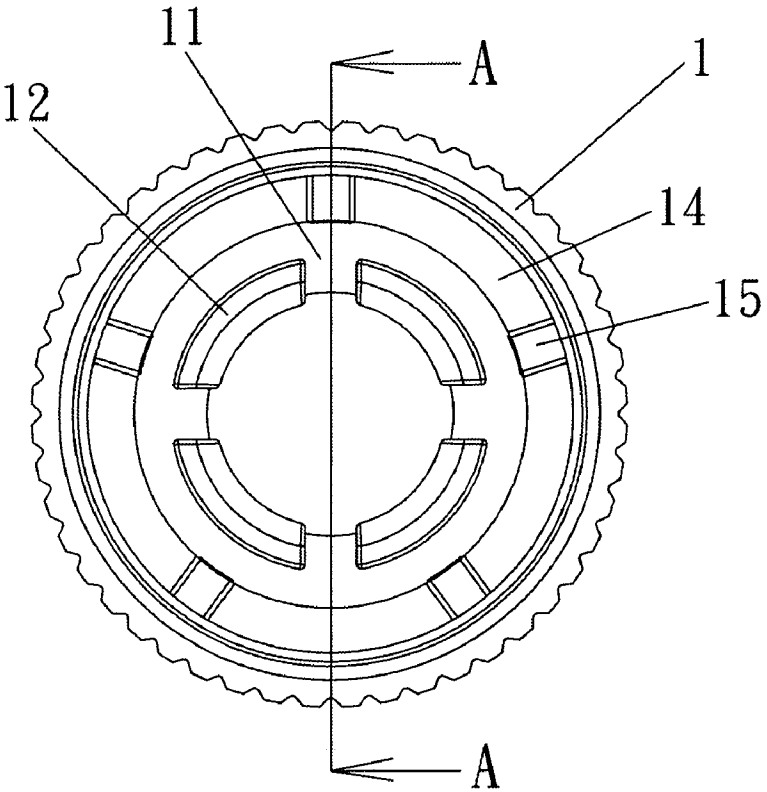
FIG. 5 is an end view of the reception member of the present invention.
Figure 7:
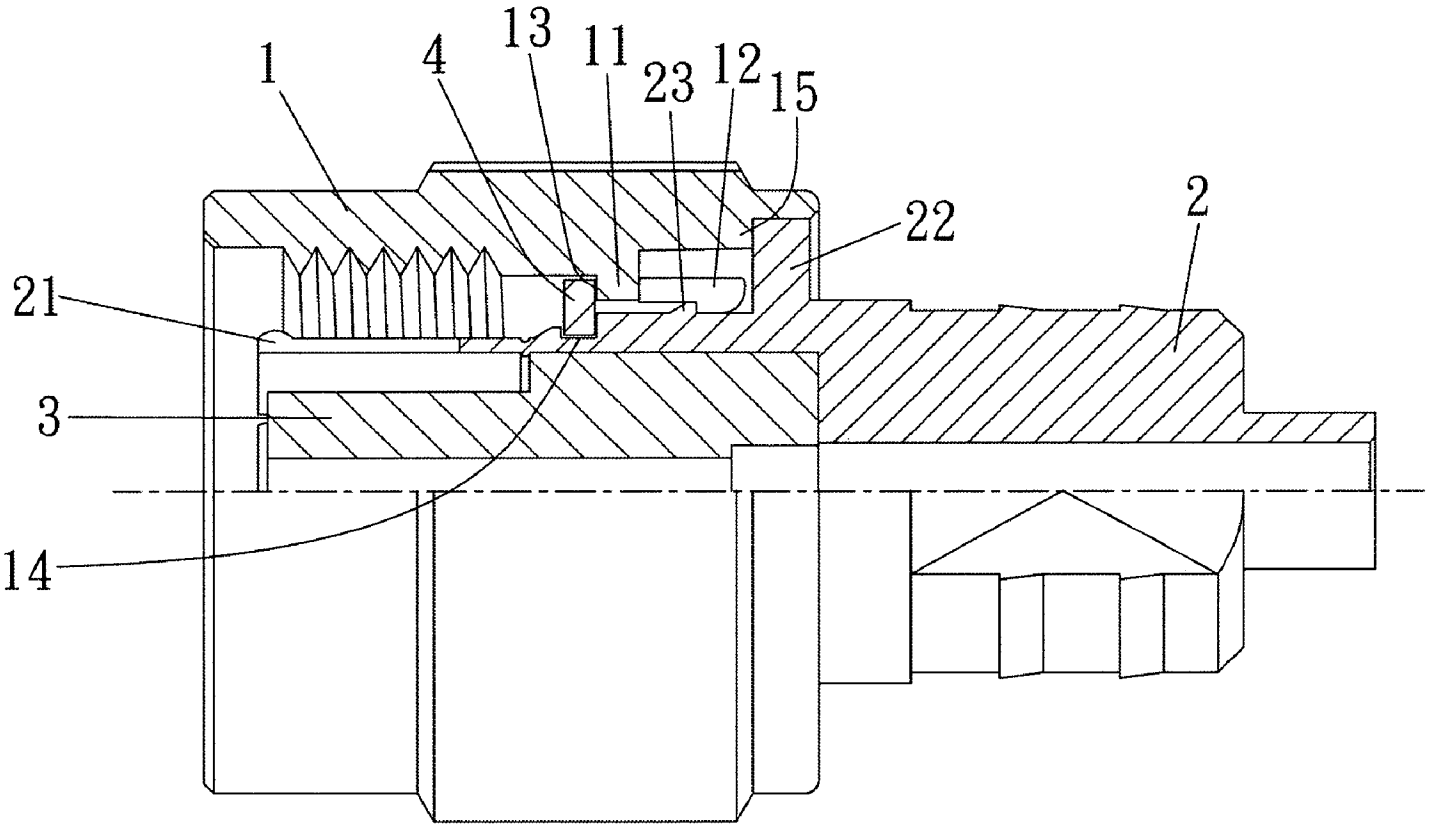
FIG. 7 is a cross sectional view to show that the antenna terminal is connected with the reception member of the present invention.

Referring to FIGS. 4 to 7, the antenna assembly of the present invention comprises a reception member 1 and an antenna terminal 2, wherein the reception member 1 has an annular flange 11 extending from an inner periphery thereof and a plurality of claws 12 extend from a surface of the annular flange 11. A flat surface 13 is defined in an end of the annular flange 11 and located opposite the claws 12. An annular gap 14 is defined between the claws 12 and the inner periphery of the reception member 1. so that the claws 12 have proper flexibility. A plurality of ribs 15 extend from the inner periphery of the reception member 1 and are located in the annular gap 14.

The antenna terminal includes a metal core member 2 which has an insertion end 21 so as to be inserted into the reception member 1. An outer flange 22 extends from an outer periphery of the metal core member 2 and a stepped surface 23 is defined in the outer periphery of the metal core member 2. The isolation member 3 is inserted into the insertion end 21 of the metal core member 2 and the insertion end 21 is inserted into the reception member 1. The claws 12 claw the outer periphery of the metal core member 2 and the outer flange 22 contact the ribs 15. The metal core member 2 has a groove 24 in which a C-clip 4 is engaged, the C-clip 4 is in contact with the flat surface 13 of the annular flange 11.

Figure 8:
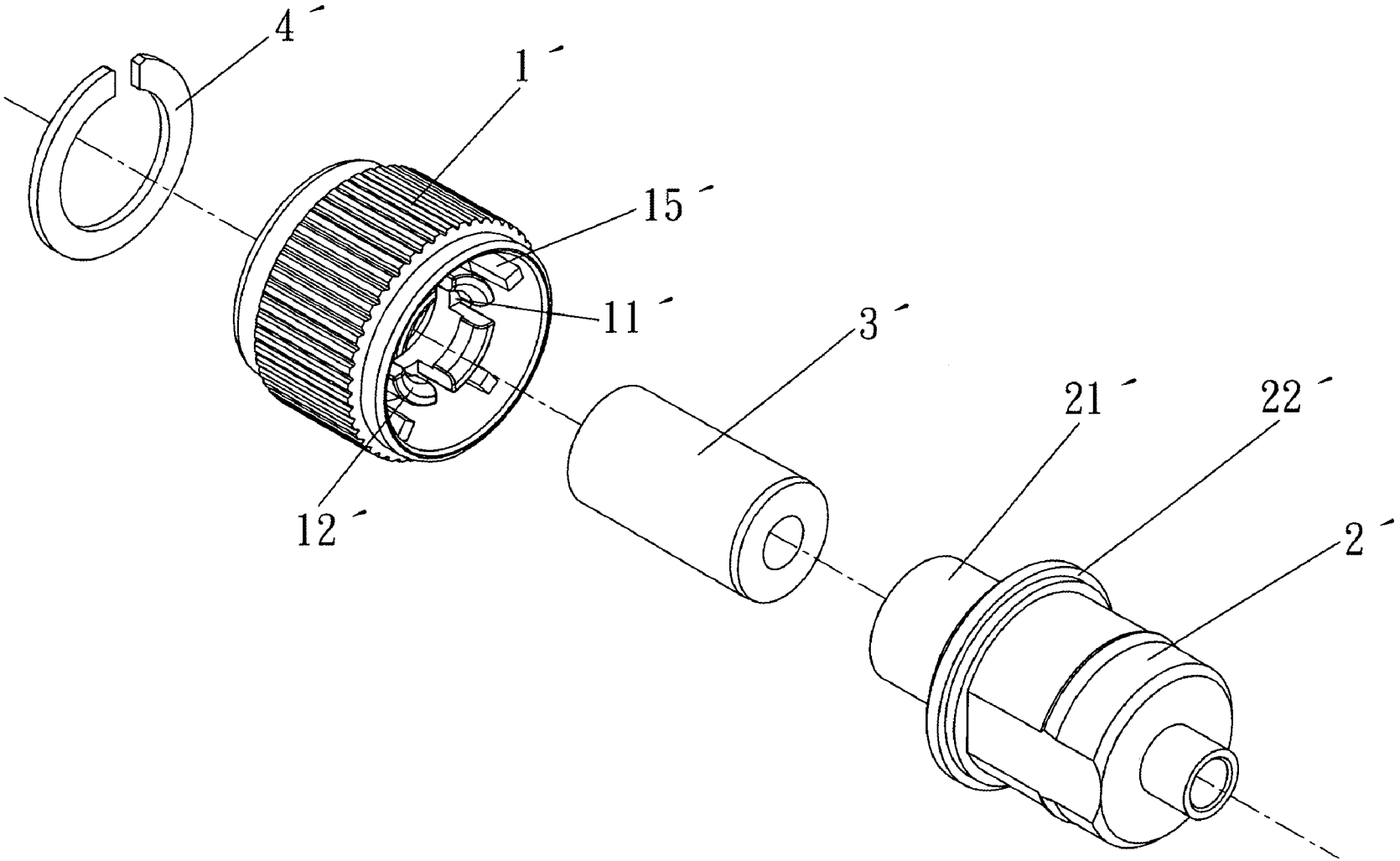
FIG. 8 is an exploded view to show another embodiment of the antenna terminal and the reception member of the present invention.
Figure 10:
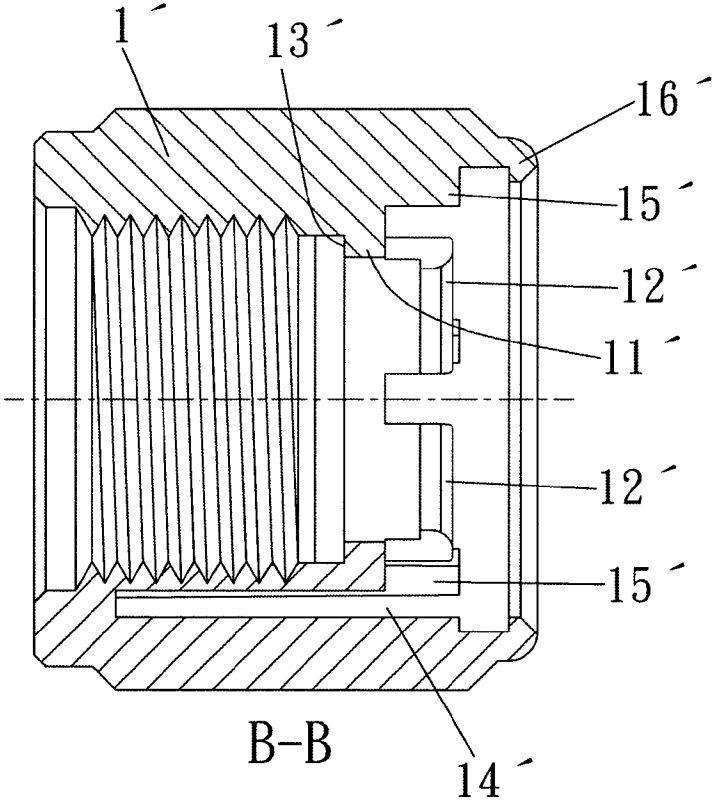
FIG. 10 is a cross sectional view along line B-B in FIG. 9.
Figure 9:
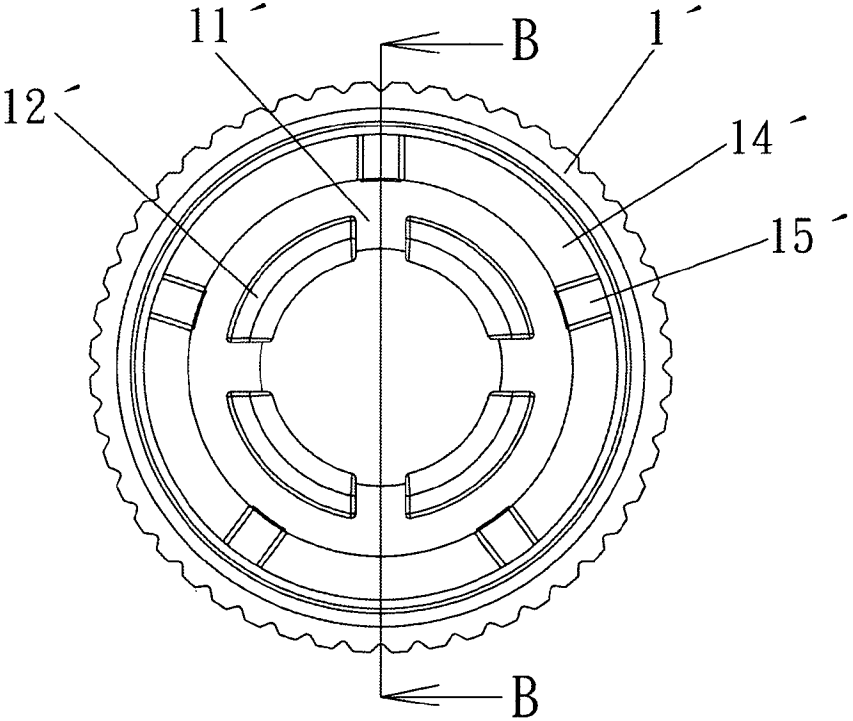
FIG. 9 is an end view of the reception member in FIG. 8 of the present invention.
Figure 11:
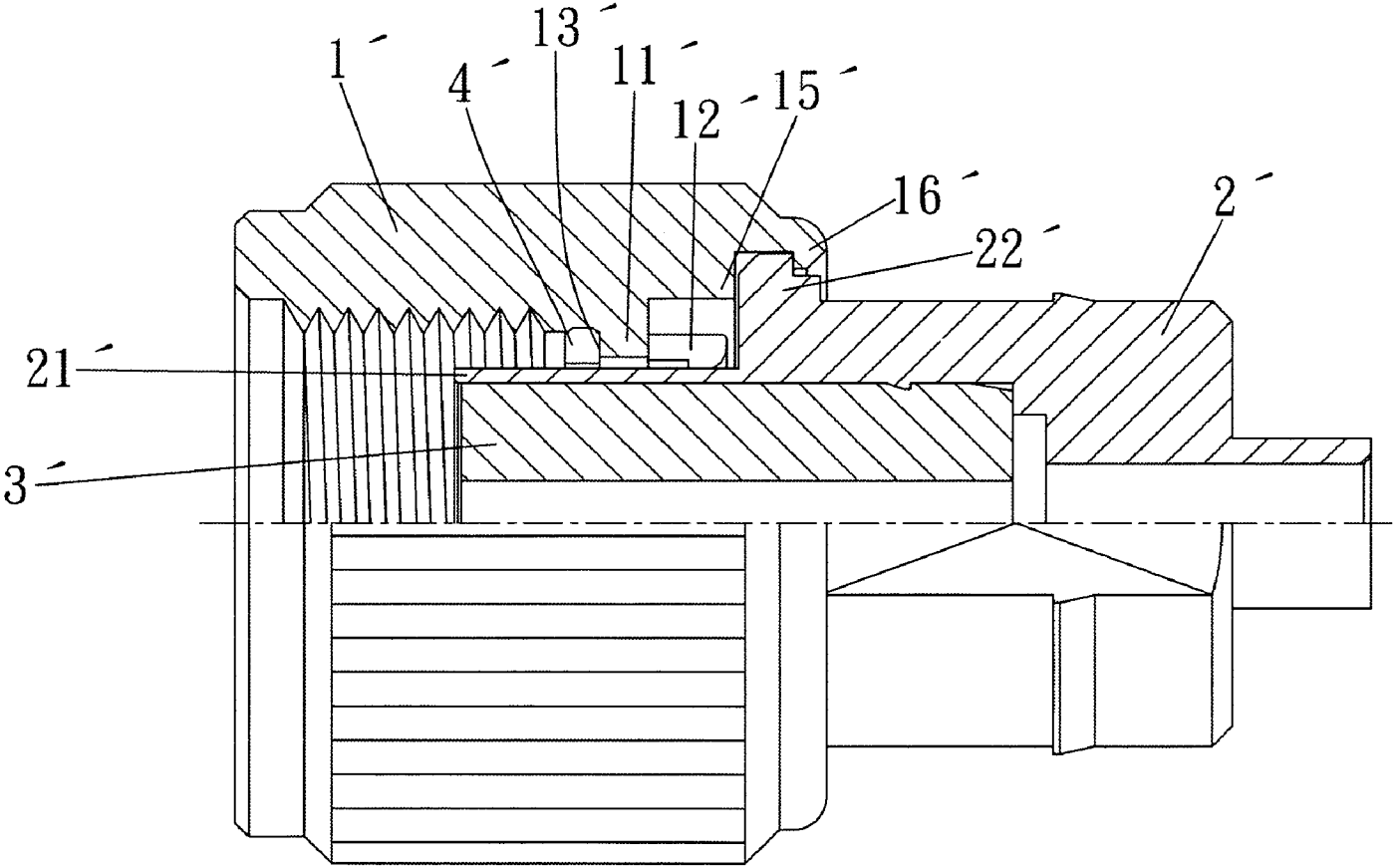
FIG. 11 is a cross sectional view to show that the antenna terminal is connected with the reception member in FIG. 8 of the present invention.

FIGS. 8 to 11 show another embodiment of the present invention wherein the reception member 1' has an annular flange 11' extending from an inner periphery thereof and a plurality of claws 12' extend from a surface of the annular flange 11'. A flat surface 13' is defined in an end of the annular flange 11' and located opposite the claws 12'. An annular gap 14' is defined between the claws 12' and the inner periphery of the reception member 1'. so that the claws 12' have proper flexibility. A plurality of ribs 15' extend from the inner periphery of the reception member 1' and are located in the annular gap 14'.

The antenna terminal includes a metal core member 2' which has an insertion end 21' so as to be inserted into the reception member 1'. An outer flange 22' extends from an outer periphery of the metal core member 2'. The isolation member 3' is inserted into the insertion end 21' of the metal core member 2' and the insertion end 21' is inserted into the reception member 1'. The claws 12' claw the outer periphery of the metal core member 2' and the outer flange 22' contact the ribs 15'. A conductive ring 4 is located in the reception member 1' and in contact with the flat surface 13' of the annular flange 11'. A hooked flange 16' extends inward from an end of the reception member 1' and are hooked to the outer flange 22' of the metal core member 2'.

The claws 12, 12' are integral with the reception member 1, 1' so that they are not moved during rotation of the antenna so that no noise is generated. Besides, no spring and rolling process are needed, so that the assembly time and manufacturing cost are reduced.

While we have shown and described the embodiment in accordance with the present invention, it should be clear to those skilled in the art that further embodiments may be made without departing from the scope of the present invention.

What is claimed is:

1. An antenna assembly comprising:

a reception member having an annular flange extending from an inner periphery thereof and a plurality of claws extending from a surface of the annular flange, an annular gap defined between the claws and the inner periphery of the reception member, a plurality of ribs extending from the inner periphery of the reception member and located in the annular gap, and an antenna terminal including a metal core member having an insertion end which is inserted into the reception member, an outer flange extending from an outer periphery of the metal core member, the claws clawing the outer periphery of the metal core member and the outer flange contacting the ribs.

2. The assembly as claimed in claim 1, wherein a stepped surface is defined in the outer periphery of the metal core member and the claws claw the stepped surface.

3. The assembly as claimed in claim 1, wherein a hooked flange extends inward from an end of the reception member and are hooked to the outer flange of the metal core member.

4. The assembly as claimed in claim 1, wherein a flat surface is defined in an end of the annular flange and located opposite the claws, the metal core member has a groove in which a C-clip is engaged, the C-clip is in contact with the flat surface of the annular flange.

5. The assembly as claimed in claim 1, wherein a flat surface is defined in an end of the annular flange and located opposite the claws, a conductive ring is located in the reception member and in contact with the flat surface of the annular flange.

* * * * *